US010760887B2

(12) United States Patent
Campbell et al.

(10) Patent No.: US 10,760,887 B2
(45) Date of Patent: Sep. 1, 2020

(54) DETONATION TRANSFER ASSEMBLY

(71) Applicant: Goodrich Corporation, Charlotte, NC (US)

(72) Inventors: Matthew Campbell, Dixon, CA (US); Luis G. Interiano, Galt, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 594 days.

(21) Appl. No.: 15/153,257

(22) Filed: May 12, 2016

(65) Prior Publication Data

US 2017/0350681 A1 Dec. 7, 2017

(51) Int. Cl.

| | |
|---|---|
| ***F42D 1/04*** | (2006.01) |
| ***C06B 35/00*** | (2006.01) |
| ***C06B 33/10*** | (2006.01) |
| ***C06B 25/04*** | (2006.01) |
| ***C06C 7/00*** | (2006.01) |

(52) U.S. Cl.

CPC ..... *F42D 1/04* (2013.01); *C06B 25/04* (2013.01); *C06B 33/10* (2013.01); *C06B 35/00* (2013.01); *C06C 7/00* (2013.01)

(58) Field of Classification Search

CPC ..... F42B 39/20; F42B 39/14; F42D 1/04

See application file for complete search history.

(56) References Cited

U.S. PATENT DOCUMENTS

| | | | | |
|---|---|---|---|---|
| 4,597,261 | A * | 7/1986 | Dolan | F42B 39/20 60/223 |
| 5,466,537 | A * | 11/1995 | Diede | F02K 9/38 102/364 |
| 6,615,737 | B2 | 9/2003 | Bonnel et al. | |
| 7,363,847 | B2 * | 4/2008 | Reed | F42B 39/14 89/36.17 |
| 7,377,690 | B1 * | 5/2008 | Diede | F42B 39/14 102/364 |
| 7,530,314 | B2 * | 5/2009 | Skinner | F42B 39/20 102/378 |
| 7,739,956 | B2 * | 6/2010 | Ljungwald | F42B 39/20 102/481 |
| 8,191,351 | B2 * | 6/2012 | Loehr | F02K 9/18 60/223 |
| 8,307,767 | B2 * | 11/2012 | Skinner | F42B 39/20 102/275.11 |
| 8,776,689 | B2 | 7/2014 | Gonsalves et al. | |
| 2006/0207460 | A1 * | 9/2006 | Reed | F42B 39/14 102/202.5 |
| 2007/0240600 | A1 * | 10/2007 | Skinner | F42B 39/20 102/481 |

(Continued)

*Primary Examiner* — Benjamin P Lee

(74) *Attorney, Agent, or Firm* — Snell & Wilmer L.L.P.

(57) ABSTRACT

A detonation transfer assembly is disclosed. A detonation transfer assembly may comprise an external casing comprising an input end and an output end axially opposite the input end, an explosive column spanning axially inside the external casing, a primary explosive disposed within the explosive column, and a secondary explosive disposed within the explosive column axially between the primary explosive and the output end. The primary explosive and/or the secondary explosive may comprise a thermally insensitive initiation material that resists at least one of detonation or thermal degradation in response to temperature increase rate of 3.3° C. per hour over at least twenty hours.

9 Claims, 4 Drawing Sheets

(56) References Cited

U.S. PATENT DOCUMENTS

| | | | | |
|---|---|---|---|---|
| 2011/0146517 | A1* | 6/2011 | Wuensche | F42B 3/10<br>102/200 |
| 2015/0239910 | A1* | 8/2015 | Klapotke | C07F 1/08<br>548/107 |

* cited by examiner

DETONATION TRANSFER ASSEMBLY

FIELD

The present disclosure relates generally to thermally-initiated venting systems, and more particularly, to detonation transfer assemblies.

BACKGROUND

Thermally-initiated venting systems may be implemented in energetic systems and configured to reduce the violence of the reaction of an energetic assembly in response to a known threat, for example, a propellant in a rocket motor exposed to an external heat source, such as a fire. Thermally-initiated venting systems may comprise a detonation transfer assembly configured to transfer a detonation or energy from one part of a thermally-initiated venting system to another, in order to cause a reaction, such as the ignition of an explosive material. Detonation transfer assemblies should be able to be exposed to fast cook-off (i.e., direct, immediate exposure to high heat, such as a fire) and/or slow cook-off (i.e., the exposure to gradually increasing temperature over an extended period of time) without ignition or detonation and without thermal degradation.

SUMMARY

In various embodiments, a detonation transfer assembly may comprise an external casing comprising an input end and an output end axially opposite the input end, an explosive column spanning axially inside the external casing, a primary explosive disposed within the explosive column, and/or a secondary explosive disposed within the explosive column axially between the primary explosive and the output end. The primary explosive and/or the secondary explosive may thermally insensitive initiation material that may resist detonation and/or thermal degradation in response to a temperature increase rate of 3.3° C. per hour over at least twenty hours.

In various embodiments, the primary explosive may comprise lead azide and/or copper(I) 5-nitrotetrazolate. In various embodiments, the secondary explosive may comprise hexanitrostilbene and/or nonanitroterphenyl. In various embodiments, the primary explosive may comprise the same thermally insensitive initiation material as the secondary explosive. In various embodiments, the detonation transfer assembly may comprise a primer comprised within the external casing between the explosive column and the input end. In various embodiments, a column height of the explosive column may be less than one-third of a casing height of the external casing. In various embodiments, a column height of the explosive column may gradually increase from a first portion of the explosive column to a second portion of the explosive column.

In various embodiments, a thermally-initiated venting system may comprise a first stage pyrotechnic, a detonation transfer assembly coupled to the first stage pyrotechnic and configured to be actuated by the first stage pyrotechnic, and/or an energetic transfer line coupled to the detonation transfer assembly, wherein the energetic transfer line is configured to be ignited by the detonation transfer assembly. The detonation transfer assembly may comprise a primary explosive and a secondary explosive disposed axially-adjacent to the primary explosive. The primary explosive and/or the secondary explosive may comprise a thermally insensitive initiation material that resists detonation and/or thermal degradation in response to a temperature increase rate of 3.3° C. per hour over at least twenty hours. In various embodiments, the primary explosive and/or the secondary explosive may comprise a thermally insensitive initiation material that resists detonation and/or thermal degradation in response to a temperature increase rate of 3.3° C. per hour over at least 48 hours.

In various embodiments, the primary explosive may comprise lead azide and/or copper(I) 5-nitrotetrazolate. In various embodiments, the secondary explosive may comprise hexanitrostilbene and/or nonanitroterphenyl. In various embodiments, the primary explosive may comprise the same thermally insensitive initiation material as the secondary explosive.

In various embodiments, a method of igniting a thermally-initiated venting system may comprise igniting a first stage pyrotechnic, igniting a primary explosive in a detonation transfer assembly in response to the igniting the first stage pyrotechnic, igniting a secondary explosive in the detonation transfer assembly in response to the igniting the primary explosive, igniting an energetic transfer line in response to the igniting the secondary explosive, and/or damaging a vessel comprising a propellant in response to the igniting the energetic transfer line. The secondary explosive may comprise hexanitrostilbene and/or nanonitroterphenyl.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

All ranges may include the upper and lower values, and all ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

Figure 1A:
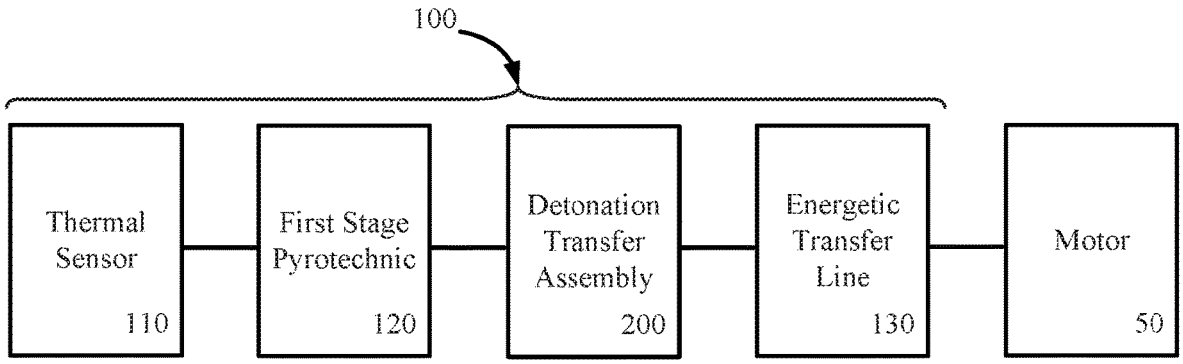
FIG. 1A illustrates a block diagram of a thermally-initiated venting system coupled to a motor, in accordance with various embodiments.

Referring to FIG. 1A, a block diagram of a thermally-initiated venting ("TIV") system 100 is depicted, in accordance with various embodiments. In various embodiments, TIV system 100 may comprise a thermal sensor 110, a first stage pyrotechnic 120 coupled to thermal sensor 110, a detonation transfer assembly 200 coupled to first stage pyrotechnic 120, and/or an energetic transfer line 130 coupled to detonation transfer assembly 200. TIV system 100 may be coupled to a motor 50, or any other device comprising a propellant or other explosive that may benefit from hazard mitigation in response to being exposed to a thermal threat. For instance, TIV system 100 may prevent motor 50 from propelling a missile (which comprises motor 50) in response to being exposed to a thermal threat, such as a fire. In various embodiments, energetic transfer line 130 may be coupled to motor 50.

In various embodiments, thermal sensor 110 may be any thermally-sensitive ignition device that reacts at an actuation temperature (e.g., chemically reacts), and in response, actuates and/or ignites first stage pyrotechnic 120. In various embodiments, thermal sensor 110 may comprise a melting alloy, which gives an output energy in response to achieving an actuation temperature. The output energy may ignite first stage pyrotechnic 120. In various embodiments, thermal sensor 110 may comprise a shape memory alloy. The shape memory alloy may comprise titanium (Ti), Nickel (Ni), Zirconium (Zr), Hafnium (Hf), Palladium (Pd), Gold (Au), Platinum (Pt), Aluminum (Al), Niobium (Nb), and/or Tantalum (Ta). For example, the shape memory alloy may comprise a Ti—Ni alloy, a (Ti—Zr)—Ni alloy, a (Ti—Hf)—Ni alloy, a Ti—(Ni—Pd) alloy, a Ti—(Ni—Au) alloy, a Ti—(Ni—Pt) alloy, a Ti—Al alloy, a Ti—Nb alloy, Ti—Pd alloy, and/or a Ti—Ta alloy. The shape memory alloy may be configured to transition from a first geometry to a second geometry, or from the second geometry to the first geometry, in response to the shape memory alloy achieving an actuation temperature. Therefore, the actuation temperature may cause thermal sensor 110 to change geometry, in response to thermal sensor 110 comprising a shape memory alloy, which may ignite first stage pyrotechnic 120. In various embodiments, thermal sensor 110 may be a reactive material configured to give an output energy in response to reaching an actuation temperature, and the output energy be configured to ignite first stage pyrotechnic 120.

In various embodiments, first stage pyrotechnic 120 may be ignited by the energy produced by thermal sensor 110. First stage pyrotechnic 120 may comprise any reactive material capable of being ignited by the energy output of thermal sensor 110, and capable of creating an output energy from the reactive material. For example, first stage pyrotechnic 120 may comprise black powder and/or boron potassium nitrate ($BKNO_3$). The output energy from first stage pyrotechnic 120 may ignite detonation transfer assembly 200. In various embodiments, the output energy from first stage pyrotechnic 120 may comprise heat, expanding gases, a shock wave, and/or any other energy capable of actuating and/or igniting detonation transfer assembly 200. For example, first stage pyrotechnic 120 may chemically react and produce expanding gas. The expanding gas may mechanically act on an ignition device, such as a firing pin, causing the firing pin to strike and actuate, initiate, and/or ignite detonation transfer assembly 200.

Figure 2:
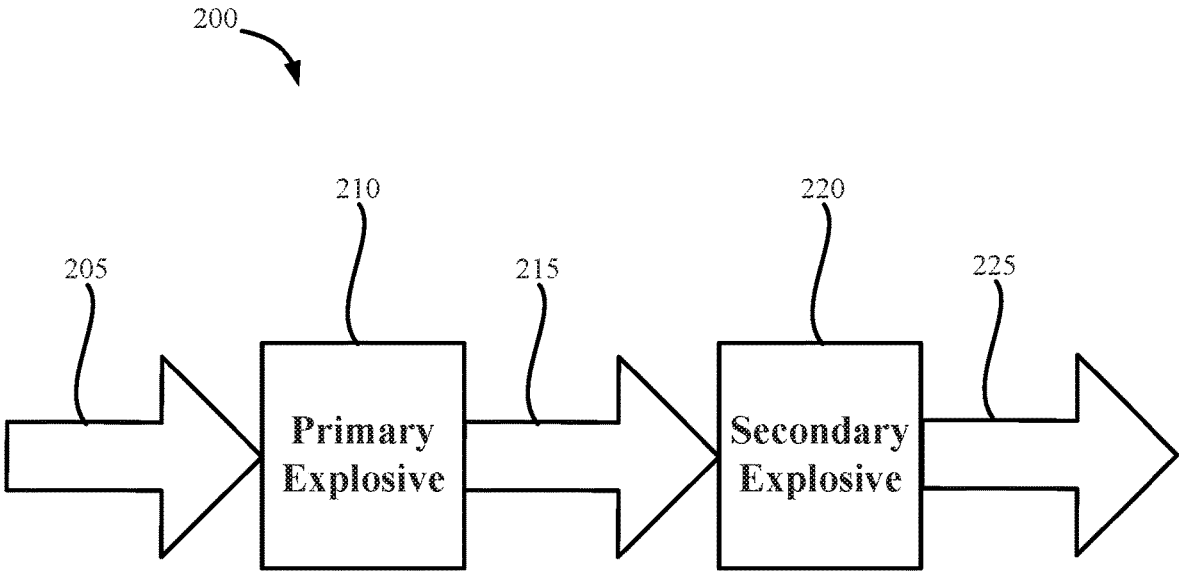
FIG. 2 illustrates a schematic view of a detonation transfer assembly, in accordance with various embodiments.

In various embodiments, with combined reference to FIGS. 1A and 2, detonation transfer assembly 200 may comprise a primary explosive 210 and a secondary 220 adjacent to primary explosive 210. In operation, input energy 205 may include, for example, the mechanical energy from first stage pyrotechnic 120 (e.g., movement of a firing pin), and/or energy produced by the actuation or ignition of an initiator 303 (depicted in FIGS. 3A-3C), such as a primer. Input energy 205 may, in response, ignite primary explosive 210. Primary explosive 210 may ignite and/or detonate, creating transfer energy 215. Transfer energy 215 produced by primary explosive 210 may provide the energy necessary to ignite and/or detonate secondary explosive 220 and cause secondary explosive 220 to detonate. The detonation of secondary explosive 220 may produce transfer output energy 225, which may be configured to ignite energetic transfer line 130.

In various embodiments, detonation transfer assembly 200 may be configured to withstand slow cook-off without primary explosive 210 and/or secondary explosive 220 igniting, detonating, or otherwise actuating, and/or without primary explosive 210 and/or secondary explosive 220 thermally degrading. Thermal degradation may entail a material, such as primary explosive 210 and/or secondary explosive 220, degrading in response to exposure to heat such that the material will no longer actuate, ignite, and/or detonate when desired and/or triggered. Slow cook-off is the exposure to gradually increasing temperature over an extended period of time. Slow cook-off may comprise a temperature, starting at 50° C. (122° F.), and a temperature increase rate of 3.3° C. (5.9° F.) per hour for at least 20 hours. In various embodiments, the slow cook-off may comprise a temperature increase rate of 3.3° C. (5.9° F.) per hour for at least 40 hours or 48 hours. In various embodiments, the slow cook-off may comprise a temperature increase rate of 3.3° C. per hour for at least 60 hours. Accordingly, primary explosive 210 and/or secondary explosive 220 may comprise thermally insensitive initiation materials, which are materials having the chemical stability to withstand mechanical or energetic shocks, the rapid and/or slow increase in temperature, and/or impact by a physical object, without igniting, detonating, and/or actuating. More specifically, primary explosive 210 and/or secondary explosive 220 may comprise thermally insensitive initiation materials capable of resisting detonation, ignition, and/or thermal degradation in response to exposure to slow cook-off, and/or prolonged exposure to temperatures ranging from 116° C. (240° F.) to 177° C. (350° F.). In various embodiments, primary explosive 210 and/or secondary explosive 220 may comprise thermally insensitive initiation materials capable of withstanding prolonged exposure to temperatures ranging from 116° C. (240° F.) to 204° C. (400° F.), or temperatures ranging from 177° C. (350° F.) to 204° C. (400° F.).

In various embodiments, primary explosive 210 may comprise lead azide (molecular formula: $Pb(N_3)_2$), a lead-free alternative to lead azide such as copper(I) 5-nitrotetrazolate, which is know in industry as "DBX-1" (molecular formula: $C_2Cu_2N_{10}O_4$), and/or any other suitable primary explosive 210 that can withstand slow cook-off in conjunction with secondary explosive 220. Lead azide has an auto-ignition temperature of 300° C. (572° F.). The auto ignition temperature is the temperature at which a reactive material will spontaneously ignite under normal atmospheric conditions without an external source of ignition, such as a spark. The chemical structure of DBX-1 is show in Diagram 1 below, which has an auto-ignition temperature of about 340° C. (644° F.) to 360° C. (680° F.). As used only in this context, the term "about" refers to plus or minus 10° C. (18° F.). Therefore lead azide and DBX-1 do not have a risk of igniting without an external ignition source until temperatures reach about 300° C. (572° F.) or above, wherein the term "about" as used in this context only, means plus or minus 10° C.

DIAGRAM 1

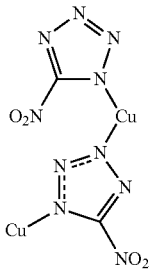

In various embodiments, secondary explosive 220 may comprise hexanitrostilbene ("HNS"), nonanitroterphenyl ("NONA"), and/or any other suitable secondary explosive 220 that can withstand slow cook-off in conjunction with primary explosive 210. HNS has an ignition onset temperature of about 320° C. (608° F.), which is preceded by an endothermic melt that occurs at about 317° C. (603° F.). NONA is very thermally stable, having a melting point of 440° C. (824° F.). As used only in this context, the term "about" refers to plus or minus 10° C. (18° F.). In various embodiments, primary explosive 210 and secondary explosive 220 may comprise the same thermally insensitive initiation material. In various embodiments, primary explosive 210 and secondary explosive 220 both may comprise, for example, lead azide, DBX-1, HNS, and/or NONA.

In various embodiments, energetic transfer line 130 may be configured to be actuated and/or ignited by transfer output energy 225 created by detonation transfer assembly. Energetic transfer line 130 may be, for example, a linear shape charge comprising an explosive material configured to weaken and/or rupture a metal casing coupled to the linear shape charge. For example, energetic transfer line 130, such as a linear shape charge, may be disposed adjacent to a motor 50, such as a rocket motor. In operation, energetic transfer line 130 may be actuated and/or ignited by transfer output energy 225, causing the explosive material in energetic transfer line 130 to detonate. Such a detonation may result in the damaging of, i.e., the weakening or destruction of, a portion of a vessel, such as a motor case, which may house a propellant. The propellant may be ignited by the explosion of the explosive material in energetic transfer line 130. In various embodiments in which the vessel is a motor case, the motor case may be weakened by the explosion of the explosive material in energetic transfer line 130, and the propellant within the motor case may ignite without an external ignition source, but instead, the propellant may ignite as a result of heat and pressure around the motor case. The detonation of the explosive material in energetic transfer line 130 may mitigate a potential hazard, such as exposure to a thermal threat such as a fire, by venting energy from the propellant to prevent the rocket or missile comprising the propellant from moving and/or exploding. Otherwise, the thermal threat may cause an explosion of the propellant, causing the rocket or missile comprising the propellant to be propelled in a direction or explode. In various embodiments, energetic transfer line 130 may transfer an energetic signal to another component within TIV system 150 or to a separate system.

Figure 1B:
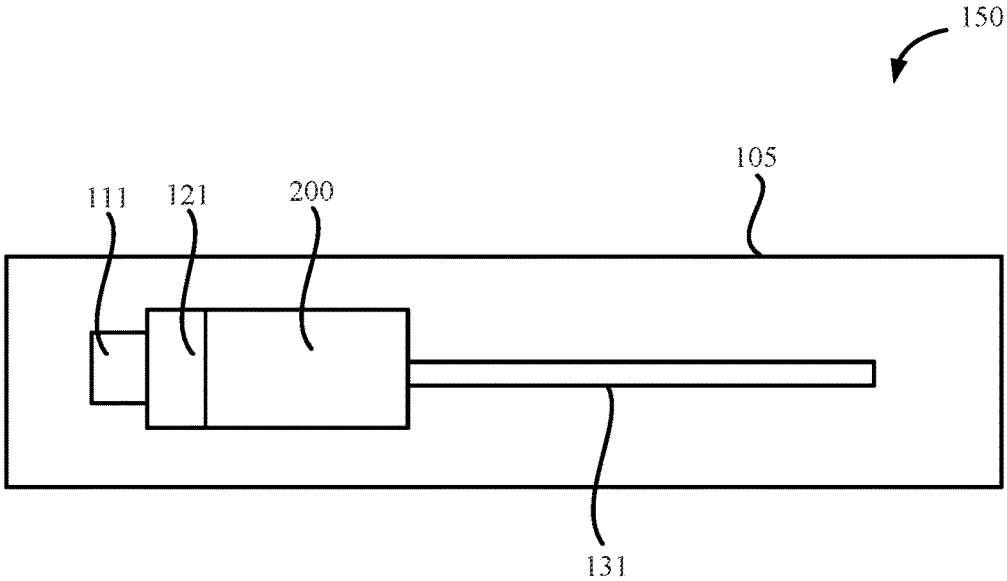
FIG. 1B illustrates a thermally-initiated venting system, in accordance with various embodiments.

FIG. 1B depicts a TIV system 150, in accordance with various embodiments. TIV system 150 may comprise a thermal sensor 111, a first stage pyrotechnic 121 coupled to thermal sensor 111, a detonation transfer assembly 200 coupled to first stage pyrotechnic 121, and/or an energetic transfer line 131. As depicted in FIG. 1B, energetic transfer line 131 is a linear shape charge. TIV system 150 may further comprise a system casing 105, which may house the other components of TIV system 150. System casing 105 may be coupled to a motor 50 such that at least energetic transfer line 131 (e.g., linear shape charge) is coupled to the motor and/or motor case. In response to energetic transfer line 131 being coupled to the motor and/or motor case, in operation, in response to actuation, ignition, and/or detonation of energetic transfer line 131, a propellant in motor and/or motor case may be ignited, and/or the motor case may be damaged, i.e., weakened or ruptured, as described herein.

Figure 3A:
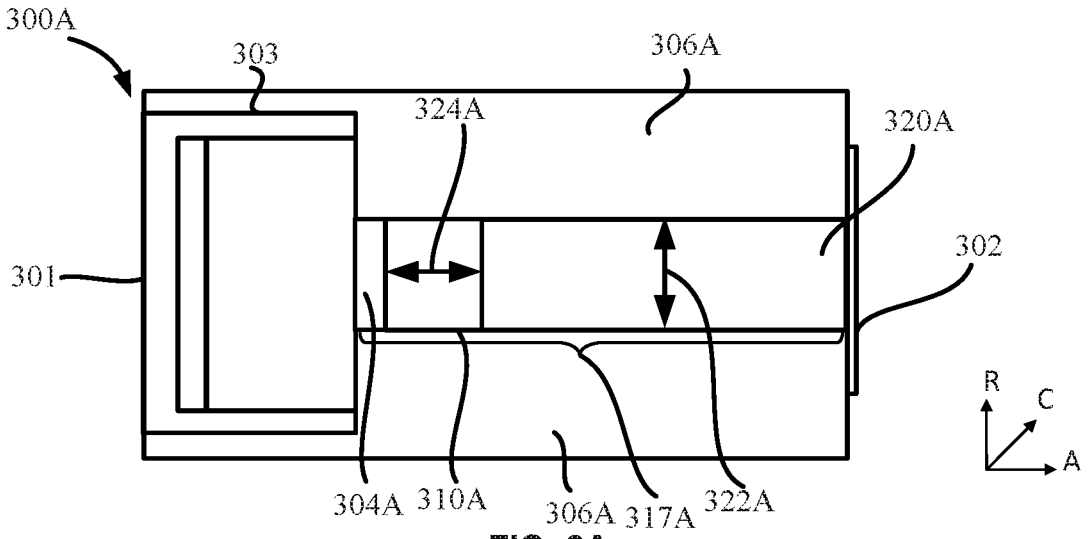
FIGS. 3A-3C illustrate detonation transfer assemblies, in accordance with various embodiments.
Figure 3B:
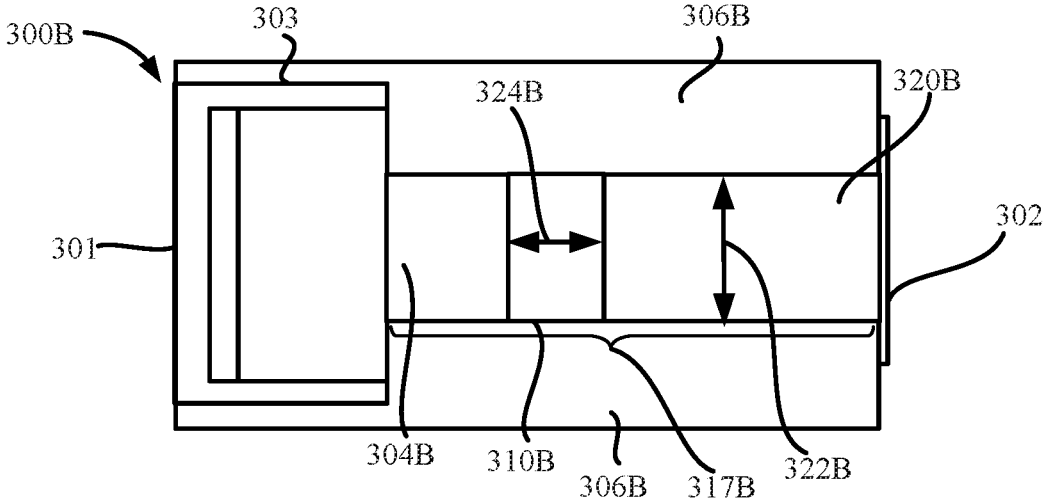
Figure 3C:
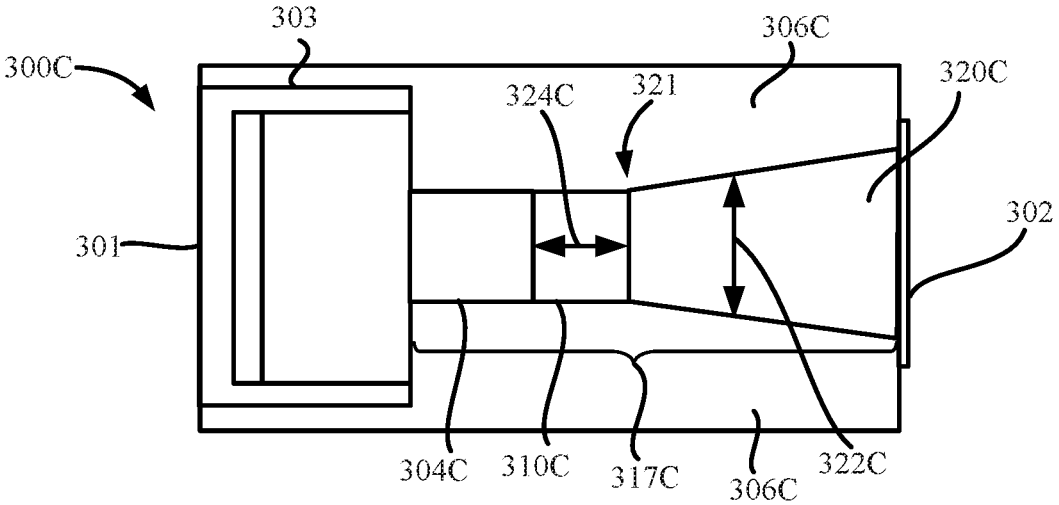

FIGS. 3A-3C depict detonation transfer assemblies 300A-300C, respectively, in accordance with various embodiments. An A-R-C axis has been included in the drawings to illustrate the axial (A), radial (R) and circumferential (C) directions. In various embodiments, detonation transfer assemblies 300A-300C may comprise an external casing 306A-306C, respectively. External casing 306A-306C may be comprised of any suitable material, such as stainless steel. Detonation transfer assemblies 300A-300C and/or external casings 306A-306C may comprise an input end 301 and an output end 302 axially opposed of input end 301. In various embodiments, detonation transfer assemblies 300A-300C may comprise an initiator 303 adjacent to input end 301. With brief reference to FIGS. 2 and 3A-3C, initiator 303 may be a device configured to create input energy 205 to ignite primary explosive 210. In various embodiments, initiator 303 may be a primer comprising a primer mix of explosive material which is configured to detonate in response to being triggered, but also configured to avoid detonation in environments including temperatures of 204° C. (400° F.) and above.

In various embodiments, an explosive column 317A-317C in detonation transfer assemblies 300A-300C, respectively, may be disposed axially-adjacent to initiator 303 and span axially between initiator 303 and output end 302. In various embodiments, within explosive columns 317A-317C, there may be a column void 304A-304C, respectively, adjacent to initiator 303. A primary explosive 310A-310C may be disposed axially-adjacent to column voids 304A-304C, respectively, in explosive columns 317A-317C, respectively. A secondary explosive 320A-320C may be disposed axially-adjacent to primary explosives 310A-310C, respectively, and output end 302.

In various embodiments, explosive columns 317A-317C may comprise various dimensions depending on the explosive materials used as primary and/or secondary explosives. In various embodiments in which a primary and/or secondary explosive is used that has a detonation energy that is less than tradition explosive materials used in detonation transfer assemblies such as hexogen ($C_2H_6N_6O_6$) ("RDX") or octogen ($C_4H_8N_8O_8$) ("HMX"), more of the primary and/or secondary explosive will be required to achieve the same detonation energy as the traditional explosive materials. For example, HMX has an energy of detonation of 10.87 KJ/cc, while HNS has an energy of detonation of 8.08 KJ/cc. Therefore, in order to achieve the same amount of detonation energy with HNS as would have been produced by HMX, a greater mass of HNS should be used than HMX in the explosive column, which is associated with an adjustment of the dimensions of explosive column 317A-317C. In various embodiments, a column height, such as column height 322A of explosive column 317A, may be uniform across the axial length of the explosive column. With reference to FIG. 3A, in various embodiments, a column height 322A of explosive column 317A may be less than one-third the height of detonation transfer assembly 300A, and/or less than one-third the height of external casing 306A. With reference to FIG. 3B, in various embodiments, a column height 322B may be greater than one-third the height of detonation transfer assembly 300B, and/or greater than one-third the height of external casing 306B. Accordingly, explosive column 317B may have a larger cross-sectional area than explosive column 317A.

Referring to FIG. 3C, in various embodiments, the column height of an explosive column may not be uniform across the axial length of the explosive column. In various embodiments, column height 322C may increase from a first portion of explosive column 317C to a second portion of explosive column 317C. In various embodiments, the first portion may be at the portion of secondary explosive 320C that is closest to primary explosive 310C. In various embodiments, the first portion may be the portion of explosive column 317C adjacent to column void 304C, and/or adjacent to initiator 303. In various embodiments, the second portion may be output end 302 or adjacent to output end 302. In various embodiments, the second portion may be adjacent to secondary explosive 320C, primary explosive 310C, and/or column void 304C. As depicted in FIG. 3C, the first portion is point 321, and the second portion is at output end 302 such that column height 322C increases throughout the axial span of secondary explosive 320C. Therefore, the second portion of explosive column 317C at output end 302 has a larger cross-sectional area than the first portion of explosive column 317C at point 321. Such a configuration may be to allow more of the primary and/or secondary explosive into detonation transfer assembly 200 to achieve a desired transfer output energy 225 (depicted in FIG. 2).

In various embodiments, the lengths 324A-324C of different sections of explosive columns 317A-317C, respectively, may vary. As depicted in FIGS. 3A-3C, the lengths 324A-324C of primary explosives 310A-310C, respectively, may vary depending on the desired volume of primary explosive 310A-310C within explosive columns 317A-317C, respectively. The desired volume of primary explosive 310A-310C may depend on the column height 322A-322C, respectively, throughout explosive columns 317A-317C, respectively. The lengths of secondary explosives 320A-320C and/or column voids 304A-304C may also vary depending on the desired volume of primary explosives 310A-310C, secondary explosives 320A-320C, and/or column voids 304A-304C, respectively, which may also depend on the column height 322A-322C throughout explosive columns 317A-317C, respectively. As discussed herein, the desired volume of primary explosives 310A-310C and/or secondary explosives 320A-320C may depend on a desired detonation energy to be achieved by primary explosives 310A-310C and/or secondary explosives 320A-320C.

In various embodiments, primary explosives 310A-310C and/or secondary explosives 320A-320C may comprise thermally insensitive initiation materials, as described herein. For example, primary explosives 310A-310C may comprise lead azide, DBX-1, and/or any other suitable primary explosive. Secondary explosives 320A-320C may comprise, for example, HNS, NONA, and/or any other suitable secondary explosive.

In operation, with reference to FIGS. 1A, 1B, 2, and 3A-3C, initiator 303 may receive the output energy from first stage pyrotechnic 120, via a firing pin, for example. Initiator 303 may be a primer, and the primer mix within the primer may ignite and cause energy to flow through column void 304A-304C. In response, primary explosive 310A-310C may be ignited, which may result in secondary explosive 320A-320C igniting, and in response, transfer output energy 225 may be created.

In various embodiments, referring back to FIG. 2, primary explosive 210 may comprise the same thermally insensitive initiation material as secondary explosive 220, such that there is one thermally insensitive initiation material in the explosive column (such as explosive columns 317A-317C in FIGS. 3A-3C) in detonation transfer assembly 200. In various embodiments, primary explosive 210 and secondary explosive 220, i.e., the one thermally insensitive initiation material, may comprise, for example, lead azide, DBX-1, HNS, and/or NONA. In various embodiments, in which primary explosive 210 and secondary explosive 220 comprise the one thermally insensitive initiation material, the one thermally insensitive initiation material may be ignited by an exploding foil initiator, which may be comprised in initiator 303 (depicted in FIGS. 3A-3C). In various embodiments, the exploding foil initiator may not be a component of detonation transfer assembly 200. An exploding foil initiator may comprise a metal foil which is explosively vaporized, for example, by applying a high voltage (i.e., several thousand volts) of electric current to the metal foil, and in response, a projectile may be propelled at a high velocity (e.g., thousands of meters per second) toward the one thermally insensitive initiation material. A high-velocity impact by of the projectile with the one thermally insensitive initiation material may ignite the one thermally insensitive initiation material, causing the one thermally insensitive initiation material to detonate and create transfer output energy 225. In various embodiments, in which primary explosive 210 and secondary explosive 220 comprise the one thermally insensitive initiation material, the TIV system 100 (depicted in FIG. 1A) may or may not comprise thermal sensor 110 and/or first stage pyrotechnic 120.

Figure 4:
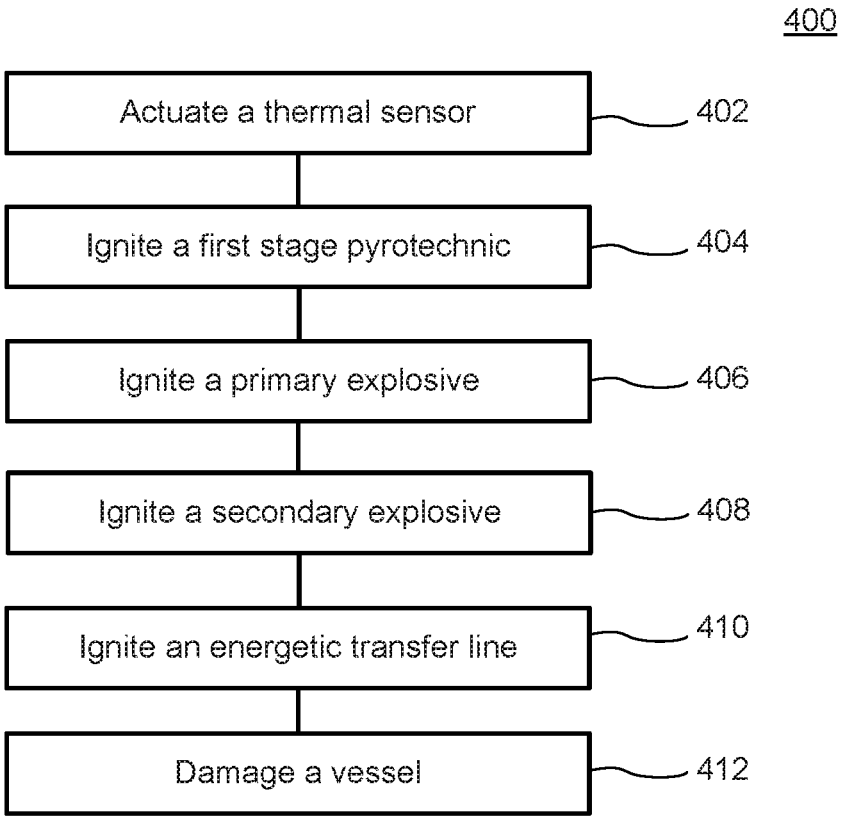
FIG. 4 illustrates a method of igniting a thermally-initiated venting system, or other explosive material, in accordance with various embodiments.

Referring to FIG. 4, a method 400 of igniting a TIV system, in accordance with various embodiments. With combined reference to FIGS. 1A, 1B, 2, and 4, a thermal sensor 110 may be actuated and/or ignited (step 402). In response to the actuation and/or ignition of thermal sensor 110, a first stage pyrotechnic 120 may be ignited (step 404). First stage pyrotechnic 120 may produce an output energy, which may mechanically act on an ignition device, such as a firing pin. The output energy from first stage pyrotechnic 120 may result in actuating and/or igniting a detonation transfer assembly 200. Actuation and/or ignition of detonation transfer assembly 200 may comprise activating and/or igniting an initiator (such as initiator 303 in FIGS. 3A-3C), for example a primer or an exploding foil initiator, igniting a primary explosive 210 (step 406) in response to initiator activation, and/or igniting a secondary explosive 220 (step 408) in response to the primary explosive 210 ignition. Ignited secondary explosive 220 may produce a transfer output energy 225, which may ignite an energetic transfer line 130 (step 410). Energetic transfer line 130 may be coupled to a vessel holding propellant, or any other detonatable material, for instance within a motor case comprising propellant. Energetic transfer line 130 may detonate in response to being ignited, and may damage, i.e., weaken and/or rupture, the vessel (step 412). Damaging the vessel holding the propellant may cause the propellant or other detonatable material within a rocket motor or other device to ignite. In various embodiments, primary explosive 210 and/or secondary explosive 220 may be any suitable thermally insensitive initiation material, as described herein. In various embodiments, primary explosive 210 and secondary explosive 220 may comprise the same material, as described herein.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A detonation transfer assembly, comprising:

an external casing comprising an input end and an output end axially opposite the input end;

an explosive column spanning axially inside the external casing;

a primary explosive comprising copper(I) 5-nitrotetrazolate disposed within the explosive column; and a secondary explosive comprising nonanitroterphenyl disposed within the explosive column axially between the primary explosive and the output end, wherein, the primary explosive and the secondary explosive comprise thermally insensitive initiation materials that resist detonation and thermal degradation in response to a temperature increase rate of 3.3° C. per hour over at least twenty hours, wherein a column height of an explosive column portion comprising the secondary explosive gradually increases from a first portion of the explosive column to a second portion of the explosive column, the second portion being more proximate the output end.

2. The detonation transfer assembly of claim 1, wherein the primary explosive further comprises lead azide.

3. The detonation transfer assembly of claim 1, wherein the secondary explosive further comprises hexanitrostilbene.

4. The detonation transfer assembly of claim 1, further comprising a primer comprised within the external casing between the explosive column and the input end.

5. The detonation transfer assembly of claim 1, wherein a column height of an explosive column portion comprising the primary explosive is less than one-third of a casing height of the external casing.

6. The detonation transfer assembly of claim 1, wherein the column height of the explosive column portion comprising the secondary explosive is configured to provide a larger volume to house the secondary explosive.

7. A thermally-initiated venting system, comprising:

a first stage pyrotechnic;

a detonation transfer assembly coupled to the first stage pyrotechnic and configured to be actuated by the first stage pyrotechnic, wherein the detonation transfer assembly comprises an explosive column comprising an input end and an output end, and a primary explosive proximate the input end and a secondary explosive proximate the output end disposed in the explosive column, wherein the primary explosive comprises copper(I) 5-nitrotetrazolate and the secondary explosive comprises nonanitroterphenyl disposed axially-adjacent to the primary explosive; and an energetic transfer line coupled to the detonation transfer assembly, wherein the energetic transfer line is configured to be ignited by the detonation transfer assembly;

wherein, the primary explosive and the secondary explosive comprise thermally insensitive initiation materials that resist detonation and thermal degradation in response to a temperature increase rate of 3.3° C. per hour over at least twenty hours, wherein a column height of the an explosive column portion comprising the secondary explosive gradually increases from a first portion of the explosive column to a second portion of the explosive column, the second portion being more proximate the output end.

8. The thermally-initiated venting system of claim 7, wherein the primary explosive further comprises lead azide.

9. The thermally-initiated venting system of claim 7, wherein the secondary explosive further comprises hexanitrostilbene.

* * * * *